US008376350B2

(12) United States Patent
Choi

(10) Patent No.: US 8,376,350 B2
(45) Date of Patent: Feb. 19, 2013

(54) PAPER FEEDING DEVICE AND IMAGE FORMING APPARATUS HAVING THE SAME

(75) Inventor: Myung Jin Choi, Seongnam-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 0 days.

(21) Appl. No.: 13/217,477

(22) Filed: Aug. 25, 2011

(65) Prior Publication Data

US 2012/0074636 A1 Mar. 29, 2012

(30) Foreign Application Priority Data

Sep. 29, 2010 (KR) ..... 10-2010-0094135

(51) Int. Cl.
*B65H 3/06* (2006.01)
*B65H 1/00* (2006.01)

(52) U.S. Cl. ..... 271/117; 271/162

(58) Field of Classification Search ..... 271/117, 271/162

See application file for complete search history.

(56) References Cited

U.S. PATENT DOCUMENTS 7,677,556 B2 * 3/2010 Murayama et al. ..... 271/162
2005/0062217 A1 * 3/2005 Asada ..... 271/162

* cited by examiner

*Primary Examiner* — David H Bollinger
(74) *Attorney, Agent, or Firm* — Stanzione & Kim, LLP

(57) ABSTRACT

An image forming apparatus includes an upper paper feeding frame that is pivotally rotated in linkage with a paper feeding tray pivotally rotatably installed to a body of the apparatus, resulting in a size reduction of the image forming apparatus.

34 Claims, 7 Drawing Sheets

PAPER FEEDING DEVICE AND IMAGE FORMING APPARATUS HAVING THE SAME

CROSS-REFERENCE TO RELATED APPLICATIONS

This application claims the benefit of priority under 35 U.S.C. §119 from Korean Patent Application No. 2010-0094135, filed on Sep. 29, 2010 in the Korean Intellectual Property Office, the disclosure of which is incorporated herein by reference in its entirety.

BACKGROUND OF THE INVENTION

1. Field of the Invention

Embodiments of the present general inventive concept relate to a paper feeding device to enable a size reduction of an image forming apparatus and an image forming apparatus having the same.

2. Description of the Related Art

Image forming apparatuses are devised to form an image on a printing medium according to input image signals. Examples of image forming apparatuses include printers, copiers, fax machines, and devices combining functions thereof.

An electro-photographic image forming apparatus includes a paper feeding device in which printing media are stored, a light scanning device to irradiate a beam according to an image signal, a developing device to form a developer image on a printing medium supplied from the paper feeding device, a fusing device to fuse the developer image to the printing medium, and a paper discharge device to discharge the printing medium, on which an image has been completely formed, to the outside.

The above mentioned paper feeding device, light scanning device, developing device, fusing device and paper discharge device are appropriately arranged on a printing medium delivery path defined in an apparatus body.

The paper feeding device includes a pickup unit to pick up and convey printing media, an upper paper feeding tray on which an actuator and a variety of sensors to sense printing media stacked on the tray are installed, and a lower paper feeding tray on which a pad or a roller to convey one sheet of printing media at a time is installed, the pickup unit and the upper and lower paper feeding trays being fixed to the apparatus body.

SUMMARY OF THE INVENTION

Therefore, it is an aspect of the present general inventive concept to provide a paper feeding device to downsize a body of an image forming apparatus and an image forming apparatus having the same.

Additional aspects of the general inventive concept will be set forth in part in the description which follows and, in part, will be obvious from the description, or may be learned by practice of the general inventive concept.

Features and/or utilities of the present general inventive concept may be realized by a paper feeding device that includes a paper feeding tray pivotally rotatable between a paper feeding position and a standby position so as to open or close a body, a rotating shaft to be rotated by a drive source installed in the body, an upper paper feeding frame to be rotated about the rotating shaft in connection with opening/closing operations of the paper feeding tray, and a pickup unit to be rotated about the rotating shaft in linkage with the upper paper feeding frame so as to pick up printing media stacked on the paper feeding tray.

The rotating shaft may be installed in the body.

The upper paper feeding frame may be located in the body when the paper feeding tray is at the standby position, and may be partially located at the outside of the body when the paper feeding tray is at the paper feeding position.

The paper feeding device may further include a binding device to bind the paper feeding tray and the upper paper feeding frame to each other.

The binding device may include a link member, both ends of which are coupled to the paper feeding tray and the paper feeding frame.

The pickup unit may include a paper feeding roller coupled to the rotating shaft, a pickup housing pivotally rotatably coupled to the rotating shaft, and a pickup roller rotatably installed to the pickup housing and adapted to be rotated in linkage with the paper feeding roller.

The pickup roller may be introduced into the body when the paper feeding tray is at the standby position, and may be located above the printing media stacked on the paper feeding tray when the paper feeding tray is at the paper feeding position.

The pickup roller may be movable to a first position corresponding to the standby position where the paper feeding tray is kept closed, a second position corresponding to the paper feeding position where the paper feeding tray is kept open, and a third position to pick up the printing media stacked on the paper feeding tray.

An elastic member may be provided between the upper paper feeding frame and the pickup housing to elastically support the pickup housing in an upward movement direction of the pickup roller.

The elastic member may include a coil spring, one end of which is supported by the upper paper feeding frame and the other end of which is supported by the pickup housing.

The paper feeding device may further include a lower paper feeding frame fixed to the body, and the lower paper feeding frame may be rotatably provided with a retard roller at a position facing the paper feeding roller, the retard roller serving to convey one sheet of the printing media conveyed by the pickup roller at a time.

The retard roller may include a torque limiter to allow the retard roller to be rotated following the paper feeding roller only when a predetermined or more torque is applied to the retard roller.

The pickup housing may further include a clutch element to selectively receive rotating power of the rotating shaft, and the clutch element may transmit the rotating power of the rotating shaft to the pickup housing so as to rotate downward the pickup housing during rotation of the rotating shaft, and may prevent the rotating power of the rotating shaft from being transmitted to the pickup housing when the pickup roller comes into contact with the printing media stacked on the paper feeding tray to thereby press the pickup housing.

The clutch element may include a clutch spring having a body portion configured to be compressively interference-fitted to a cylindrical portion of a bush fixed to the rotating shaft and a cylindrical portion of a flange provided at the pickup housing, and a sleeve surrounding the body portion, and one end of the body portion may be supported by the pickup housing, and the other end of the body portion may be supported by the sleeve.

Features and/or utilities of the present general inventive concept may also be realized by an image forming apparatus that includes a body, a paper feeding tray pivotally rotatably coupled to the body so as to open or close the body, a rotating shaft to be rotated by a drive source installed in the body, an upper paper feeding frame to be rotated about the rotating shaft in connection with opening/closing operations of the paper feeding tray, and a pickup unit to be rotated about the rotating shaft in linkage with the upper paper feeding frame so as to pick up printing media stacked on the paper feeding tray.

The paper feeding tray may be pivotally rotatable between a standby position to close the body and a paper feeding position to open the body so as to feed the printing media into the body, and the upper paper feeding frame may be introduced into the body when the paper feeding tray is at the standby position, and partially protrudes outward of the body when the paper feeding tray is at the paper feeding position.

The image forming apparatus may further include a binding device to bind the paper feeding tray and the upper paper feeding frame to each other so as to rotate the paper feeding frame in connection with opening/closing operations of the paper feeding tray.

An elastic member may be provided between the upper paper feeding frame and the pickup housing to elastically support the pickup housing in an upward movement direction of the pickup roller.

The pickup unit may include a paper feeding roller coupled to the rotating shaft, a pickup housing pivotally rotatably coupled to the rotating shaft, and a pickup roller rotatably installed to the pickup housing and adapted to be rotated in linkage with the paper feeding roller.

The pickup roller may be located in the body when the paper feeding tray is at the standby position and may be located above the printing media stacked on the paper feeding tray when the paper feeding tray is at the paper feeding position.

The image forming apparatus may further include a retard roller located to face the paper feeding roller and having a torque limiter to convey one sheet of the printing media, picked up and conveyed by the pickup roller, at a time.

The image forming apparatus may further include a clutch element including a clutch spring having a body portion configured to be interference-fitted to a cylindrical portion of a bush fixed to the rotating shaft and a cylindrical portion of a flange provided at the pickup housing and serving to pivotally rotate the pickup housing in a downward movement direction of the pickup roller upon unidirectional rotation of the rotating shaft, and a sleeve surrounding the body portion, and one end of the body portion may be supported by the pickup housing, and the other end of the body portion may be supported by the sleeve.

Features and/or utilities of the present general inventive concept may also be realized by an image forming apparatus that includes a body having a rotating shaft to be rotated by a drive source installed in the body, a paper feeding tray pivotally rotatably coupled to the body so as to be moved between a standby position to close the body and a paper feeding position to open the body for paper feeding, an upper paper feeding pivotally rotatable about the rotating shaft, a pickup unit having a first roller coupled to the rotating shaft, a second roller spaced apart from the first roller so as to be rotated in linkage with the first roller, and a pickup housing to rotatably support the second roller, the pickup housing being pivotally rotatable about the rotating shaft, and a binding device to bind the paper feeding tray and the upper paper feeding frame to each other so as to pivotally rotate the upper paper feeding frame in connection with opening/closing operations of the paper feeding tray, wherein the upper paper feeding frame is located in the body when the paper feeding tray is at the standby position, and is partially exposed to the outside of the body when the paper feeding tray is at the paper feeding position.

The second roller may be movable to a first position corresponding to the standby position, a second position corresponding to the paper feeding position so as to be located above the printing media stacked on the paper feeding tray, and a third position so as to come into contact with the printing media stacked on the paper feeding tray.

The image forming apparatus may further include a lower paper feeding frame fixed to the body, and the lower paper feeding frame may be rotatably provided with a retard roller at a position facing the first roller, the retard roller serving to convey one sheet of the printing media conveyed by the second roller at a time.

Features and/or utilities of the present general inventive concept may also include an image forming apparatus to form an image on a printing medium, the image forming apparatus including a body to define an outside shape of the image forming apparatus, a tray rotatable between an open position to expose an opening into the body to receive the printing medium into the body, and a closed position to close the opening into the body, and a pickup unit having a first end connected to a shaft inside the body and a second end including a pickup roller to revolve around the shaft, such that the second end is located inside the body when the tray is in the closed position and the second end is located outside the body and the pickup roller is located opposite the tray when the tray is in the open position.

The pickup unit may include a paper feeding roller to rotate around the shaft.

The pickup unit may include a housing mounted to the shaft, the pickup roller being mounted to an end of the housing, an upper paper-feeding frame mounted to the shaft, and an elastic member connected between the frame and the housing to bias the housing toward the frame.

A first end of the upper paper-feeding frame may be mounted to the shaft, and the image forming apparatus may further include a binding device connected between a second end of the upper paper-feeding frame and the paper feeding tray to maintain a distance within a predetermined range between the upper paper-feeding frame and the paper feeding tray.

The paper feeding tray may include a groove, and the binding device may include a protrusion to move linearly within the groove of the paper feeding tray.

The pickup unit may be movable between a first position inside the body of the image forming apparatus, a second position in which the pickup roller is positioned above the tray in an open position and in which the pickup roller is spaced apart from the tray so as to not apply pressure to the tray, and a third position in which the pickup roller applies pressure to the tray to pick up a printing medium on the tray.

The pickup unit may include at least one clutch unit to maintain the pickup roller apart from the paper feeding tray in the second position and to press the pickup roller against the paper feeding tray in the third position.

When the clutch unit presses the pickup roller against the paper feeding tray in the third position, the housing may be maintained apart from the paper feeding tray by the binding device so as to not rotate with the housing toward the paper feeding tray.

Features and/or utilities of the present general inventive concept may also be realized by a paper feeding device of an image forming apparatus, the paper feeding device including a feeding tray to feed a printing medium into the image forming apparatus, the feeding tray rotatable between a closed position and an open position, and a pickup unit including a housing having a first end connected to a shaft inside a body of the image forming apparatus and a second end to rotate around the shaft, and a pickup roller mounted to the second end of the housing to pick up a printing medium from the feeding tray of the image forming apparatus when the feeding tray is in the open position and to be located within the image forming apparatus when the feeding tray is in the closed position.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
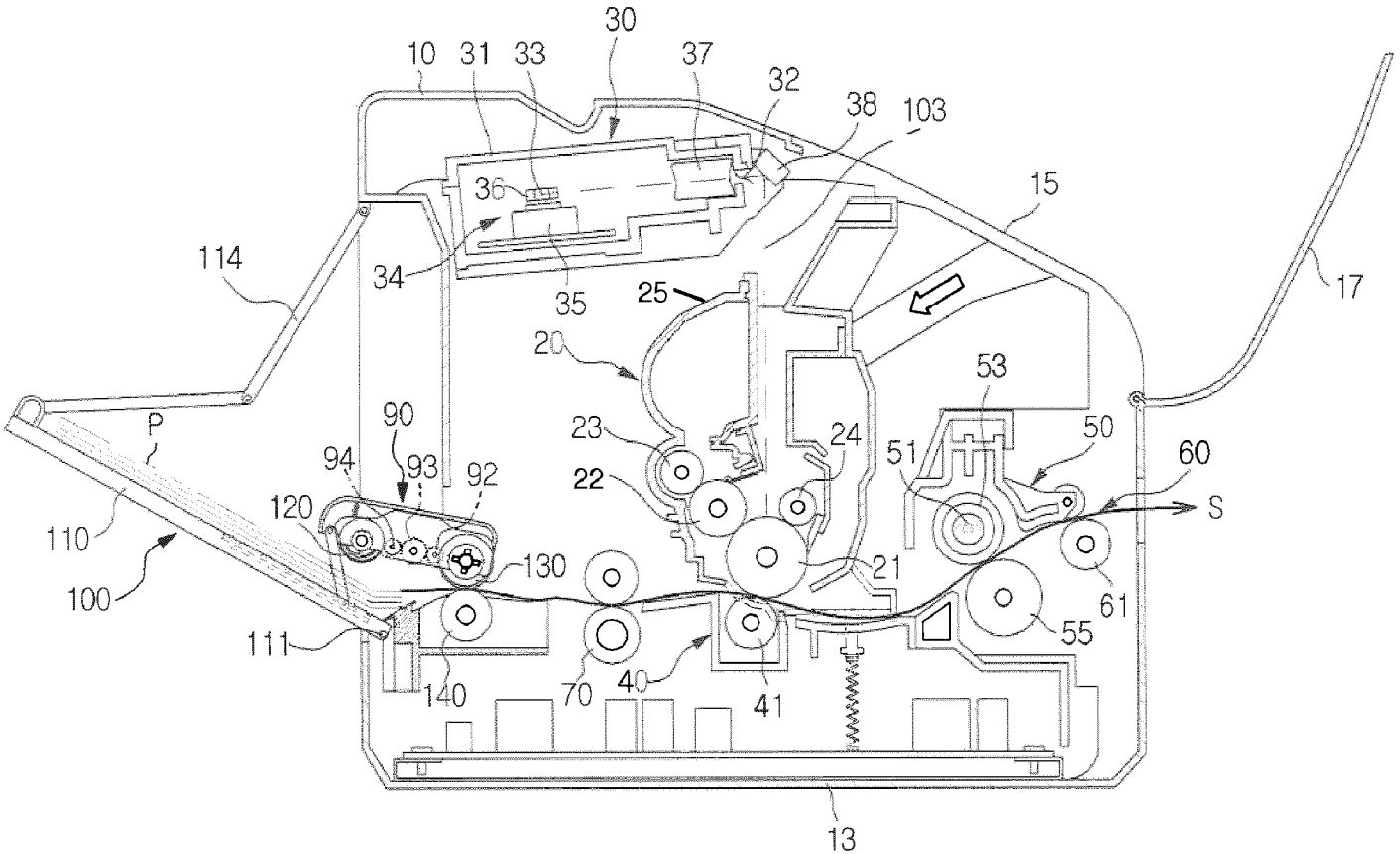
FIG. 1 is a schematic sectional view illustrating a configuration of an image forming apparatus according to an embodiment of the present general inventive concept.

Reference will now be made in detail to the embodiments of the present general inventive concept, examples of which are illustrated in the accompanying drawings, wherein like reference numerals refer to like elements throughout.

Hereinafter, an image forming apparatus according to an exemplary embodiment of the present general inventive concept will be described in detail with reference to the accompanying drawings.

FIG. 1 is a schematic sectional view illustrating a configuration of the image forming apparatus according to an embodiment of the present general inventive concept.

Referring to FIG. 1, the image forming apparatus may include a body 10, which defines an external appearance of the image forming apparatus and supports a variety of elements installed therein.

The body 10 may be provided with a paper feeding device 100, a developing device 20, a light scanning device 30, a transfer device 40, a fusing device 50, and a paper discharge device 60.

The paper feeding device 100, developing device 20, transfer device 40, fusing device 50, and paper discharge device 60, which are installed in the body 10, may be horizontally parallel to one another so as to define an approximately horizontal printing medium delivery path S.

The paper feeding device 100 includes a pickup unit 90 to pick up printing media P stacked in the paper feeding device 100 sheet by sheet and feed the printing media P toward the developing device 20. A detailed description of the paper feeding device 100 will follow.

The developing device 20 may be separably mounted in the body 10. In other words, the developing device may include one or more cartridges that may be slid into the body 10 and secured during operation, and may be removed from the body for replacement. The developing device 20 may be separably mounted in the body 10 by levers, braces, or other fasteners, instead of being permanently mounted via screws, welding, or other more permanent mounting means.

The developing device 20 may include a housing 25, in which main elements to perform a developing process, such as a photoconductive medium 21, a developing roller 22, a feed roller 23, and a charging roller 24, are mounted. The housing 25 may be mounted perpendicularly to a bottom surface 13 of the body 10 through an opening 15 formed in an upper portion of the body 10, to enable a size reduction of the body 10.

A cover 17 may be rotatably coupled to the body 10 to open or close the opening 15.

The light scanning device 30 forms an electrostatic latent image on the photoconductive medium 21 by irradiating a beam according to image information of an output object.

The light scanning device 30 may be located above the developing device 20 vertically mounted in the body 10, to irradiate a beam in a direction perpendicular to a tangential direction of the photoconductive medium 21, i.e. in a direction perpendicular to the bottom surface 13 of the body 10.

The light scanning device 30 may include a case 31 which may house a light source 33 to irradiate a beam according to an image signal, a light deflector 34 to deflect the beam emitted from the light source 33, and an F-theta lens 37 to focus the deflected beam on the photoconductive medium 21.

The light source 33 may include a laser diode to irradiate a laser beam, and the light deflector 34 may include a polygonal mirror 36 that is rotated by a drive motor 35.

The polygonal mirror 36 has a plurality of reflecting faces for deflection and scanning of the incident beam from the light source 33. The F-theta lens 37 may horizontally scan the deflected and scanned beam through a beam emission port 32 of the case 31.

A reflecting mirror 38 may be provided in front of the beam emission port 32 and may serve to reflect the horizontally scanned beam from the light scanning device 30 in a vertical direction.

The beam reflected by the reflecting mirror 38 may be scanned perpendicularly to a surface of the photoconductive medium 21 via an optical path 103 defined in the developing device 20.

The transfer device 40 serves to transfer a visible developer image formed on the photoconductive medium 21 to the printing medium P.

The transfer device 40 may include a transfer roller 41 to press the printing medium P toward the photoconductive medium 21, thereby allowing the visible developer image formed on the photoconductive medium 21 to be transferred to a surface of the printing medium P.

The fusing device 50 serves to fuse the developer image on the printing medium P by applying heat and pressure to the printing medium P.

The fusing device 50 may include a heating member 53 containing a heat source 51 and a press roller 55 to press the printing medium P toward the heating member 53.

The heating member 53 may take the form of a roller containing the heat source 51, or may take the form of a belt heated by the heat source 51.

The press roller 55 may be supported by an elastic member (not shown) so as to come into close contact with the heating member 53 to thereby maintain a constant fusing pressure between the press roller 55 and the heating member 53.

As the fusing device 50 applies heat and pressure to the visible developer image that has transferred to the printing medium P while the printing medium P passes between the heating member 53 and the press roller 55, the visible image is fused to the printing medium P.

The paper discharge device 60 includes at least one discharge roller 61 to discharge the printing medium P, having passed through the fusing device 50, to the outside of the body 10.

Figure 2:
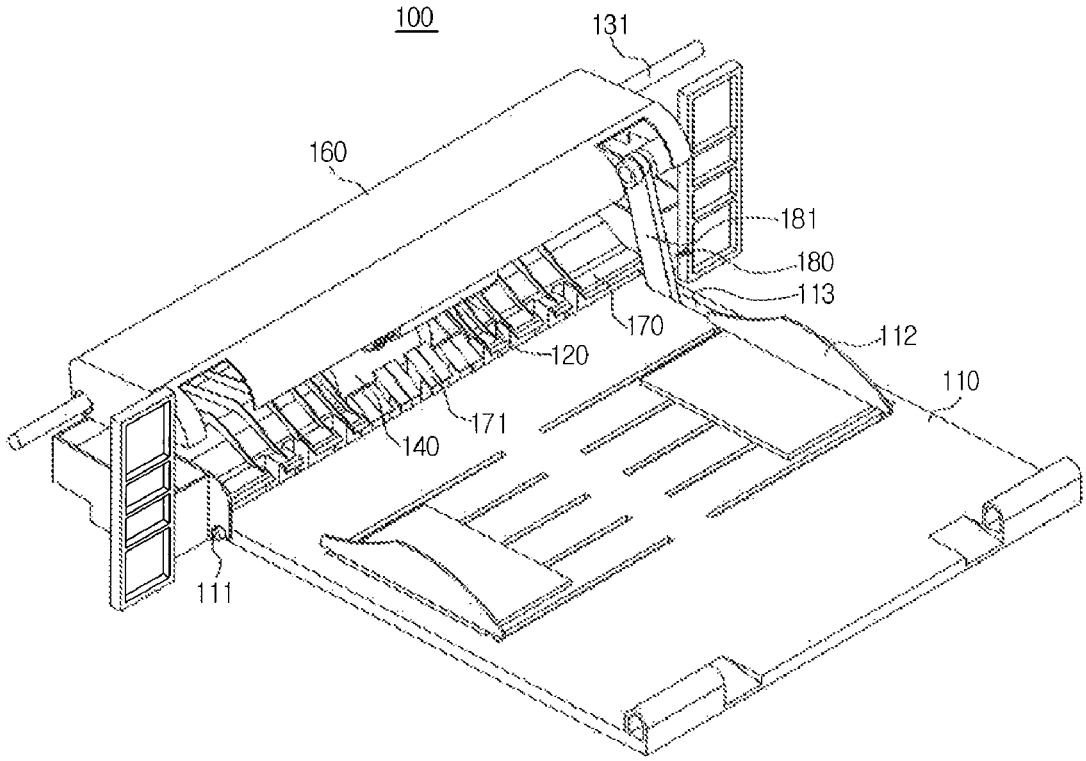
FIG. 2 is a schematic perspective view of a paper feeding device according to the embodiment of the present general inventive concept.
Figure 3:
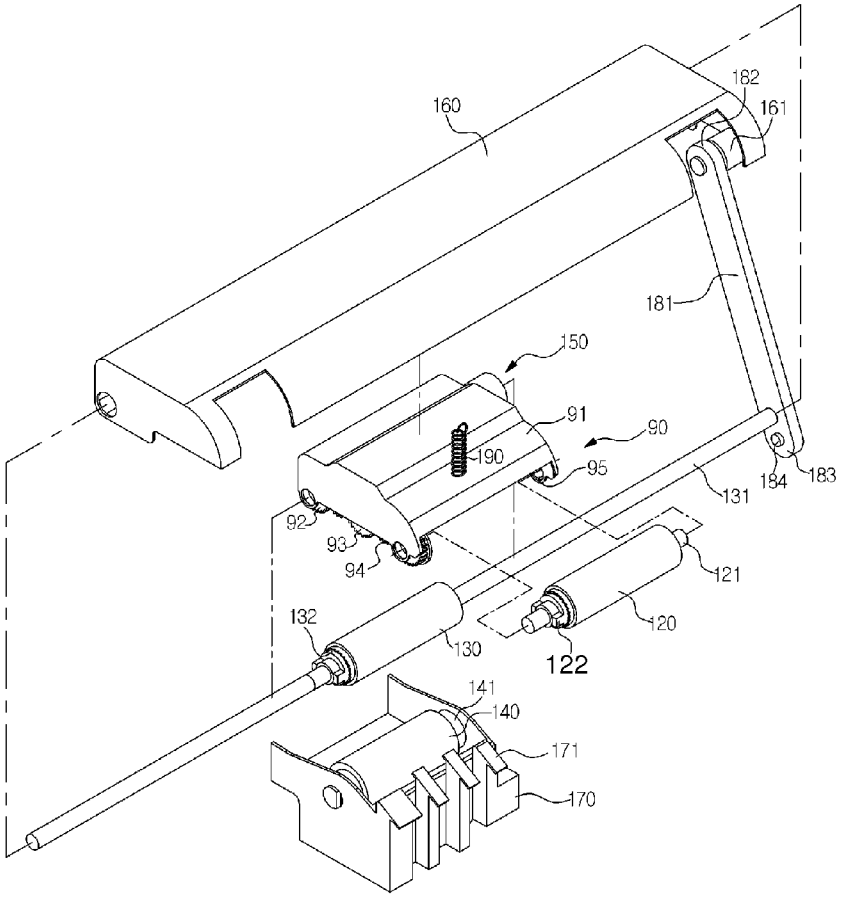
FIG. 3 is an exploded perspective view of the paper feeding device according to the embodiment of the present general inventive concept.
Figure 4:
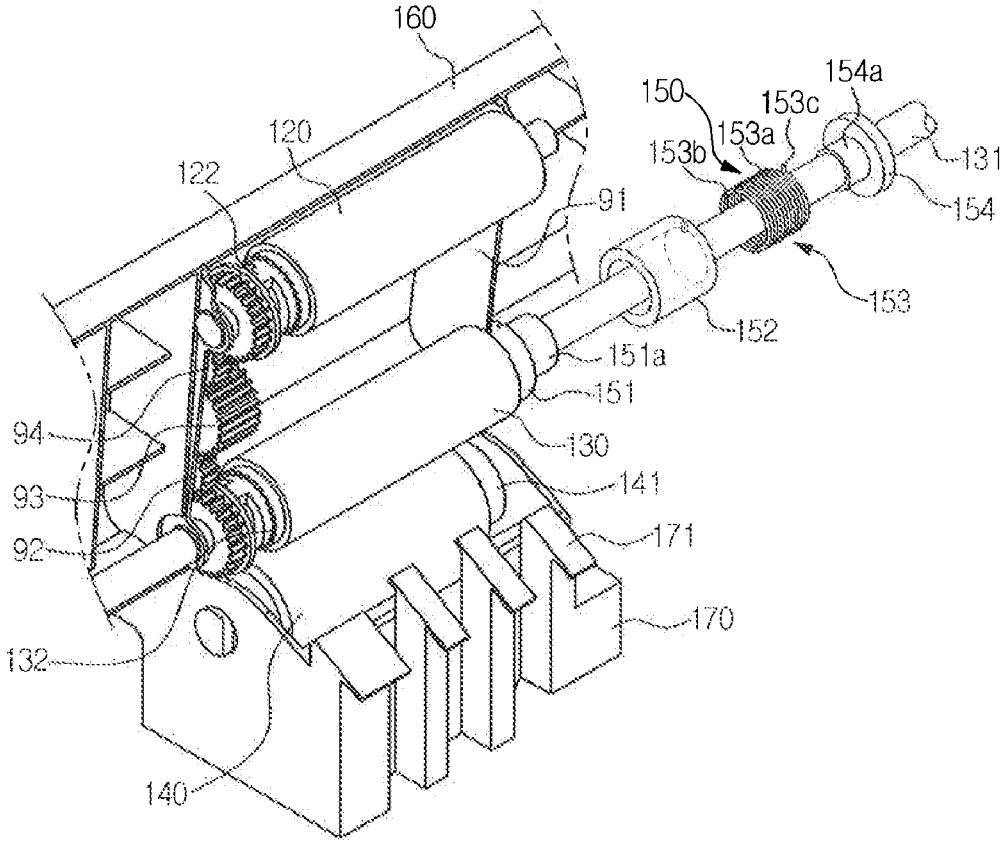
FIG. 4 is an exploded perspective view illustrating a clutch element of a pickup unit according to the embodiment of the present general inventive concept.

FIG. 2 is a schematic perspective view of the paper feeding device according to the embodiment of the present general inventive concept, FIG. 3 is an exploded perspective view of the paper feeding device according to the embodiment of the present general inventive concept, and FIG. 4 is an exploded perspective view illustrating a clutch element of a pickup unit according to the embodiment of the present general inventive concept.

Referring to FIGS. 1 to 4, the paper feeding device 100 may include a paper feeding tray 110 on which printing media P are stacked, and a pickup unit 90 to pick up the printing media P stacked on the paper feeding tray 110 one sheet at a time and feed the printing media P toward delivery rollers 70.

The paper feeding tray 110 takes the form of a plate-shaped member having a predetermined area to cover a predetermined surface region of the body 10. The paper feeding tray 110 may be coupled to the body 10 so as to be pivotally rotatable about a hinge 111 of the body 10.

The paper feeding tray 110 is movable to be opened away from the body or may be closed by being brought next to, or into, the body 10. The paper feeding tray 110 may be located at a first position where the paper feeding tray 110 is closed with respect to the body 10 (see FIG. 5) and at a second position where the paper feeding tray 110 is opened away from the body 10 (see FIG. 6).

The first position is a standby position where the paper feeding device 100 is positioned when not in use, and the second position is a paper feeding position for operation of the paper feeding device 100.

The paper feeding tray 110 is supported by the body 10 via a link 114 (see FIG. 1) so as to be kept at the second position. In other words, the link 114 may keep the paper feeding tray 110 at a constant level and supported when the paper feeding tray 110 is opened with respect to the body 10.

The paper feeding tray 110 may be provided with a guide member 112 to align the printing media P according to a width of the printing media P.

The pickup unit 90 may include a pickup roller 120, a paper feeding roller 130 to feed the printing medium P picked up by the pickup roller 120 into the body 10, and a retard roller 140 to enable feeding one sheet of the printing media P at a time.

The paper feeding roller 130 may be coupled to a rotating shaft 131 installed in the body 10.

The rotating shaft 131 may be rotated by a drive source (not shown) installed in the body 10.

Specifically, although not illustrated in the drawings, a gear to transmit rotating power of the drive source, such as a motor, to the rotating shaft 131 is connected to an end of the rotating shaft 131. Also, a power switching unit, such as an electronic clutch, is installed to selectively connect or disconnect the gear and the rotating shaft 131 to or from each other.

The pickup roller 120 may be arranged parallel to the paper feeding roller 130 with a predetermined gap therebetween.

The pickup roller 120 may be installed to be rotatable upward or downward about the rotating shaft 131 to pick up the printing medium P stacked on the paper feeding tray 110.

Also, the pickup roller 120 may be installed so as to be rotated by rotating power transmitted to the paper feeding roller 130 through the rotating shaft 131.

To this end, the pickup unit 90 may include a pickup housing 91 to rotatably support the pickup roller 120. A shaft 121 of the pickup roller 120 is rotatably inserted into a shaft hole 95 of the pickup housing 91.

The pickup housing 91 may be shaped to surround the pickup roller 120 and the paper feeding roller 130, and may be rotatably installed about the rotating shaft 131.

The pickup housing 91 may be provided with a plurality of gears 92, 93, and 94 to transmit the rotating power, transmitted to the paper feeding roller 130 through the rotating shaft 131, to the pickup roller 120.

The gears 92, 93, and 94 include a driving gear 92 coupled to the paper feeding roller 130, a driven gear 94 coupled to the pickup roller 120, and an intermediate gear 93 connecting the driving gear 92 and the driven gear 94 to each other. The intermediate gear 93 may be rotatably installed to the pickup housing 91.

With the above described configuration, if the rotating shaft 131 is rotated, the paper feeding roller 130 and the pickup roller 120 are rotated simultaneously.

A first one-way clutch 132 may be installed at a coupling position of the rotating shaft 131 and the paper feeding roller 130, and a second one-way clutch 122 may be installed at a connecting position of the driven gear 94 and the pickup roller 120. Provision of these one-way clutches serves to prevent transmission of rotating power to the rotating shaft 131 even if the paper feeding roller 130 and the pickup roller 120 are rotated during discharge of the picked-up printing medium P.

The pickup housing 91 may be provided with a clutch element 150, which rotates the pickup roller 120 to allow the pickup roller 120 to come into contact with the printing medium P stacked on the paper feeding tray 110 when the rotating shaft 131 is rotated.

The clutch element 150 may include a clutch spring 153. The clutch spring 153 serves to transmit rotating power to the pickup housing 91 to allow the pickup housing 91 to be rotated simultaneously with rotation of the rotating shaft 131. The clutch spring 153 also serves to intercept transmission of rotating power to the pickup housing 91 if the rotating power is applied in a direction opposite to that of rotating power of the rotating shaft 131.

The clutch spring 153, as illustrated in FIG. 4, includes a body portion 153*a*, which is interference-fitted to a cylindrical portion 154*a* of a bush 154 that is integrally rotated with the rotating shaft 131 and to a cylindrical portion 151*a* of a flange 151 protruding from one side of the pickup housing 91, opposite ends 153*b* and 153*c* of the body portion 153*a* extending at different angles so as to be supported by the flange 151 and a sleeve 152.

Thus, the body portion 153*a* of the clutch spring 153 may be selectively tightened onto the cylindrical portion 154*a* of the bush 154 according to a rotating direction of the pickup housing 91 so as to come into frictional contact with or be released from the cylindrical portion 154*a*.

In this way, if the rotating shaft 131 is rotated, the resultant rotating power is transmitted to the pickup housing 91 through the clutch element 150, causing the pickup housing 91 to be rotated so as to move the pickup roller 120 downward.

Thereafter, if the pickup roller 120 comes into contact with the uppermost printing medium P stacked on the paper feeding tray 110, the end 153*c* of the clutch spring 153, which comes into frictional contact with the cylindrical portion 154*a* of the bush 154, is forced to be slightly further rotated in a rotating direction of the rotating shaft 131, thereby no longer contacting the cylindrical portion 154*a* of the bush 154. As a result, the rotating power is not applied to the pickup housing 91, and only the paper feeding roller 130 and the pickup roller 120 are continuously rotated.

An upper paper feeding frame 160 may be provided above the pickup unit 90, and a lower paper feeding frame 170 may be provided below the pickup unit 90.

The upper paper feeding frame 160 is rotatably installed about the rotating shaft 131, and the lower paper feeding frame 170 is fixed to the body 10.

The lower paper feeding frame 170 may be provided with guides 171 to guide the printing medium P, picked up by the pickup roller 120, to the paper feeding roller 130. Also, the retard roller 140, which serves to convey one sheet of printing media P at a time by coming into contact with the paper feeding roller 130, may be rotatably installed at the center of the lower paper feeding frame 170.

If the pickup roller 130 picks up two or more sheets of the printing media P, the retard roller 140 serves to convey only the uppermost sheet of the printing media P.

The retard roller 140 may be provided with a torque limiter 141. The torque limiter 141 serves to allow the retard roller 140 to be rotated following the paper feeding roller 130 only if force applied to the retard roller 140 has a predetermined value or more, and to stop rotation of the retard roller 140 if force applied to the retard roller 140 is less than the predetermined value.

Specifically, when a sheet of printing medium P enters a nip region where the paper feeding roller 130 comes into contact with the retard roller 140, torque having a value equal to or greater than a preset torque of the torque limiter 141 is applied to the retard roller 140, whereby the retard roller 140 is rotated following the paper feeding roller 130 so as to feed the printing medium P into the body 10.

On the other hand, when two or more sheets of printing media P enter the nip region where the paper feeding roller 130 comes into contact with the retard roller 140, a torque less than the preset torque of the torque limiter 141 is applied to the retard roller 140, whereby the retard roller 140 is stopped to prevent a lower one of the printing media P from being fed into the body 10.

The upper paper feeding frame 160 may be rotatably coupled to the rotating shaft 131 at an upper side thereof so as to face the lower paper feeding frame 170.

Although not illustrated, the upper paper feeding frame 160 may be provided with a variety of sensors to sense the printing medium P picked up and conveyed by the pickup unit 90, an actuator, etc.

The upper paper feeding frame 160 may be rotated in connection with opening closing operations of the paper feeding tray 110 via a binding device 180 that binds the paper feeding tray 110 and the upper paper feeding frame 160 to each other.

The binding device 180 may include a link member 181, one end 182 of which is coupled to a hinge shaft 161 provided at one side of the upper paper feeding frame 160 and the other end 183 of which is inserted into a link guide 113 provided at one side of the paper feeding tray 110.

Figure 5:
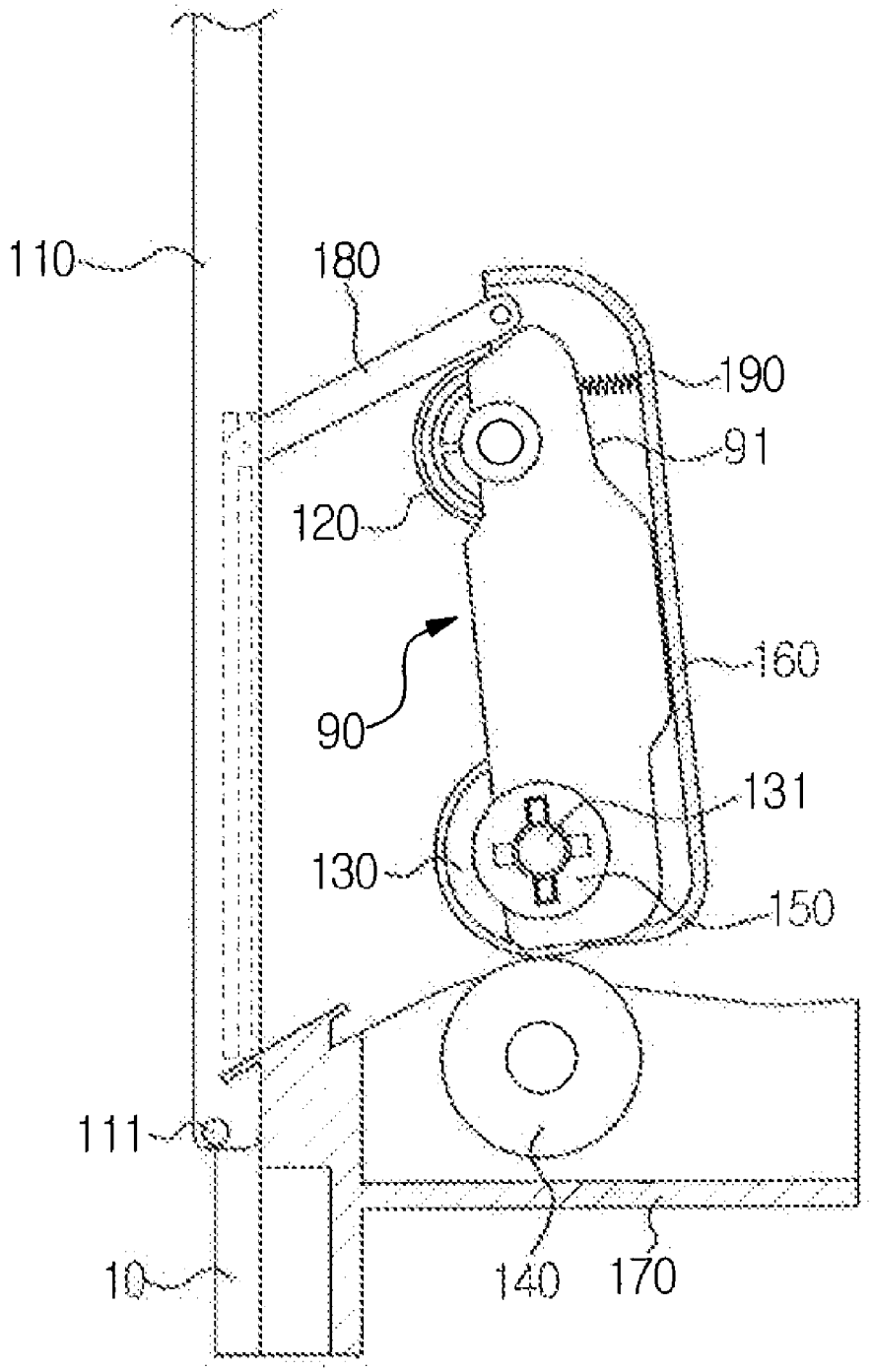
FIG. 5 is a sectional view illustrating a closed state of the paper feeding device according to the embodiment of the present general inventive concept.
Figure 6:
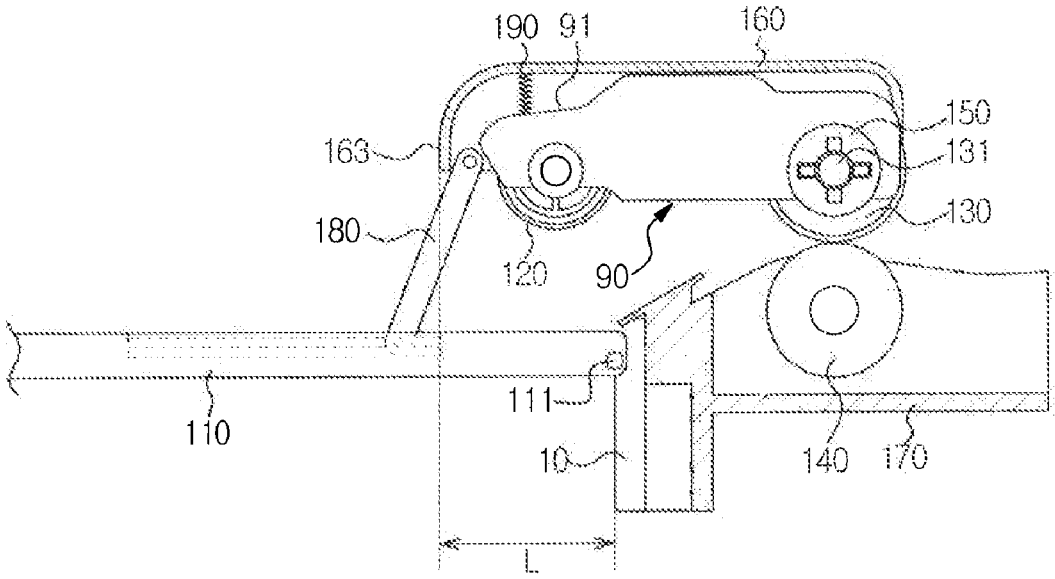
FIG. 6 is a sectional view illustrating an open state of the paper feeding device according to the embodiment of the present general inventive concept.

The other end 183 of the link member 181 may be provided with a protrusion 184 to be inserted into and be caught by a recess of the link guide 113. The protrusion 184 may slide linearly within the recess as the paper feeding tray 110 rotates about the hinge 111 and the pickup unit 90 rotates about the rotating shaft 131. As a result, when the paper feeding tray 110 is moved to an open position, as illustrated in FIG. 6, the pickup unit 90 may also be moved to a feeding or pickup position, and when the paper feeding tray 110 is moved to the closed position, as illustrated in FIG. 5, the pickup unit 90 may be moved to a storage or non-operating position.

Although the present embodiment describes the link member 181 as one example of the binding device 180, the binding device 180 is not limited in shape so long as it binds the paper feeding tray 110 and the upper paper feeding frame 160 to each other so as to rotate the upper paper feeding frame 160 in connection with rotation of the paper feeding tray 110.

An elastic member 190 may be provided between the upper paper feeding frame 160 and the pickup housing 91 to elastically support the pickup housing 91 in an upward movement direction of the pickup roller 120.

Hereinafter, operations and effects of the paper feeding device according to the embodiment of the present general inventive concept will be described.

Figure 7:
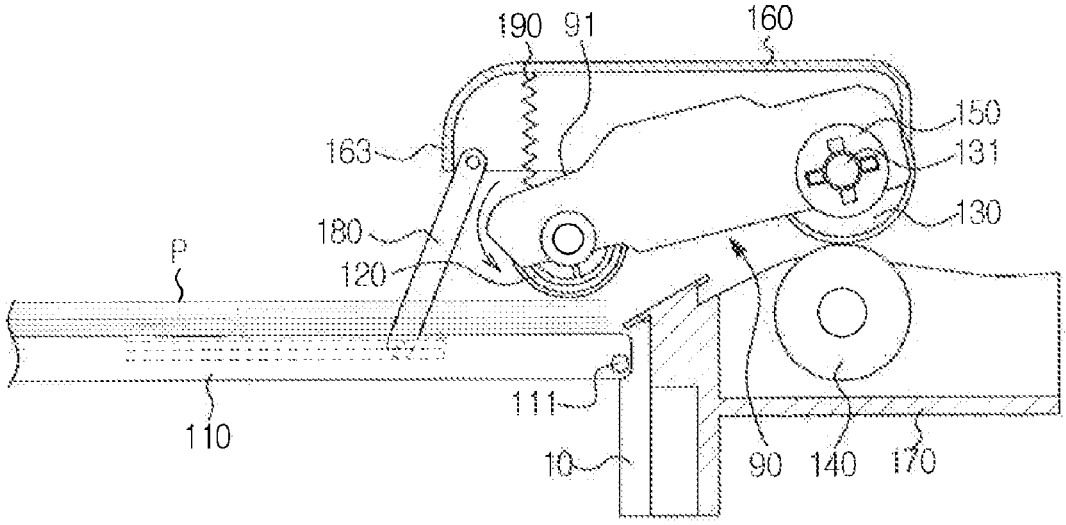
FIG. 7 is a sectional view illustrating operation of a pickup roller of the paper feeding device according to the embodiment of the present general inventive concept.

FIG. 5 is a sectional view illustrating a closed state of the paper feeding device according to an embodiment of the present general inventive concept, FIG. 6 is a sectional view illustrating an open state of the paper feeding device, and FIG. 7 is a sectional view illustrating operation of the pickup roller of the paper feeding device.

When the image forming apparatus is not in use, the paper feeding tray 110 is kept closed and is coupled to the body 10 so as to define a surface of the body 10 as illustrated in FIG. 5. Closing the paper feeding tray 110 into the body 10 provides the body 10 with a reduced size when the image forming apparatus is not in use.

In this case, the upper paper feeding frame 160 and the pickup unit 90 are received in the body 10 while being coupled to the rotating shaft 131 installed in the body 10.

Thereafter, if the paper feeding tray 110 is pivotally rotated for implementation of a printing operation, as illustrated in FIG. 6, the upper paper feeding frame 160, which is bound to the paper feeding tray 110 via the binding device 180, is moved in linkage with the paper feeding tray 110 to thereby be kept open.

In this case, a tip end 163 of the upper paper feeding frame 160 protrudes outward from the body 10 by a predetermined distance L, and the pickup roller 120 is also moved outward from the body 10 to thereby be located above the paper feeding frame 110.

The protruding distance L of the upper paper feeding frame 160 from the body 10 may be a factor to increase the size of the body 10 because the upper paper feeding frame 160 may occupy an unnecessary space if it is kept stationary as in a conventional configuration.

However, the upper paper feeding frame 160 of the present embodiment, as illustrated in FIG. 6, may be received in the body 10 when a printing operation is not being performed, and therefore, enables a reduction in the size of the body 10 without occupying an unnecessary space.

Thereafter, a printing operation is performed after the printing media P is stacked on the paper feeding tray 110. In this case, if the rotating shaft 131 is rotated by the drive source, rotating power of the rotating shaft 131 is transmitted to the pickup housing 91 via the clutch element 150, and the pickup housing 91 is moved downward and rotated about the rotating shaft 131 until the pickup roller 120 comes into contact with an uppermost one of the printing media P stacked on the paper feeding frame 110.

Once the pickup roller 120 comes into contact with the printing medium P, the clutch element 150 is operated so as not to transmit the rotating power of the rotating shaft 131 to the pickup housing 91 although the rotating shaft 131 is continuously rotated, and to allow rotation of only the pickup roller 120 and the paper feeding roller 130.

Thereby, the pickup roller 120 frictionally picks up the printing media P one sheet at a time, and conveys the printing medium P to the paper feeding roller 130.

Thereafter, if the printing operation is completed, the pickup housing 91 is rotated upward by restoration force of the elastic member 190.

With the above described configuration, in the paper feeding device 100 of the present embodiment, the pickup roller 120 may pick up the printing medium P by applying a constant press force to the printing medium P stacked on the paper feeding tray 110 regardless of the quantity of the printing media P stacked on the paper feeding tray 110.

Specifically, if a press force applied to the printing media P by the pickup roller 120 is obtained via vertical movement of the paper feeding tray 110, feeding or slippage of overlapping printing media may occur because the press force varies depending on the quantity of printing media P stacked on the paper feeding tray 110. However, in the paper feeding device 100 of the present embodiment, the pickup roller 120 acts to apply a press force to the printing medium P, achieving an improvement in the reliability of a paper feeding operation regardless of the quantity of the printing media P stacked on the paper feeding tray 110.

As is apparent from the above description, a paper feeding device and an image forming apparatus having the same according to the embodiment of the present general inventive concept may minimize the overall size of the apparatus.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. A paper feeding device comprising:

a paper feeding tray pivotally rotatable between an open paper feeding position and a closed standby position in which the paper feeding tray is closed with respect to a body of an image forming device;

a rotating shaft to be rotated by a drive source installed in the body;

an upper paper feeding frame to be rotated about the rotating shaft in connection with the open and closed positions of the paper feeding tray; and a pickup unit disposed between the paper feeding tray and the upper paper feeding frame to be revolved about the rotating shaft in linkage with the upper paper feeding frame so as to pick up printing media stacked on the paper feeding tray.

2. The paper feeding device according to claim 1, wherein the rotating shaft is installed in the body.

3. The paper feeding device according to claim 1, wherein the upper paper feeding frame is located in the body when the paper feeding tray is at the standby position, and is partially located at the outside of the body when the paper feeding tray is at the paper feeding position.

4. The paper feeding device according to claim 1, further comprising a binding device to bind the paper feeding tray and the upper paper feeding frame to each other.

5. The paper feeding device according to claim 4, wherein the binding device includes a link member having one end coupled to the paper feeding tray and an opposite end coupled to the paper feeding frame.

6. The paper feeding device according to claim 1, wherein the pickup unit includes a paper feeding roller coupled to the rotating shaft, a pickup housing pivotally rotatably coupled to the rotating shaft, and a pickup roller rotatably installed to the pickup housing and adapted to be rotated in linkage with the paper feeding roller.

7. The paper feeding device according to claim 6, wherein the pickup roller is introduced into the body when the paper feeding tray is at the standby position, and is located above the printing media stacked on the paper feeding tray when the paper feeding tray is at the paper feeding position.

8. The paper feeding device according to claim 6, wherein the pickup roller is movable to a first position corresponding to the standby position when the paper feeding tray is kept closed, a second position corresponding to the paper feeding position when the paper feeding tray is kept open, and a third position to pick up the printing media stacked on the paper feeding tray.

9. The paper feeding device according to claim 6, wherein an elastic member is provided between the upper paper feeding frame and the pickup housing to elastically support the pickup housing in an upward movement direction of the pickup roller.

10. The paper feeding device according to claim 6, wherein the elastic member includes a coil spring, one end of which is supported by the upper paper feeding frame and the other end of which is connected to the pickup housing.

11. The paper feeding device according to claim 6, further comprising a lower paper feeding frame fixed to the body, wherein the lower paper feeding frame is rotatably provided with a retard roller at a position facing the paper feeding roller to convey one sheet of the printing media conveyed by the pickup roller at a time.

12. The paper feeding device according to claim 6, wherein the retard roller includes a torque limiter to allow the retard roller to be rotated following the paper feeding roller only when a predetermined or more torque is applied to the retard roller.

13. The paper feeding device according to claim 6, wherein:

the pickup housing further includes a clutch element to selectively receive rotating power of the rotating shaft; and the clutch element transmits the rotating power of the rotating shaft to the pickup housing so as to rotate downward the pickup housing during rotation of the rotating shaft, and to prevent the rotating power of the rotating shaft from being transmitted to the pickup housing when the pickup roller comes into contact with the printing media stacked on the paper feeding tray to thereby press the pickup housing.

14. The paper feeding device according to claim 13, wherein:

the clutch element includes:

a clutch spring having a body portion configured to be compressively interference-fitted to a cylindrical portion of a bush fixed to the rotating shaft and a cylindrical portion of a flange provided at the pickup housing; and a sleeve surrounding the body portion, and wherein one end of the body portion is supported by the pickup housing, and the other end of the body portion is supported by the sleeve.

15. An image forming apparatus comprising:

a body;

a paper feeding tray pivotally rotatably coupled to the body so as to be open with respect to the body or closed with respect to the body;

a rotating shaft to be rotated by a drive source installed in the body;

an upper paper feeding frame to be rotated about the rotating shaft in connection with opening and closing operations of the paper feeding tray; and a pickup unit disposed between the paper feeding tray and the upper paper feeding frame to be rotated about the rotating shaft in connection with the upper paper feeding frame so as to pick up printing media stacked on the paper feeding tray when the paper feeding tray is in the open position.

16. The image forming apparatus according to claim 15, wherein:

the paper feeding tray is pivotally rotatable between a standby position to be closed with respect to the body and a paper feeding position to be open with respect to the body so as to feed the printing media into the body; and the upper paper feeding frame is introduced into the body when the paper feeding tray is at the standby position, and partially protrudes outward of the body when the paper feeding tray is at the paper feeding position.

17. The image forming apparatus according to claim 16, wherein the pickup unit includes a paper feeding roller coupled to the rotating shaft, a pickup housing pivotally rotatably coupled to the rotating shaft, and a pickup roller rotatably installed to the pickup housing and adapted to be rotated in linkage with the paper feeding roller.

18. The image forming apparatus according to claim 17, wherein:

the pickup roller is located in the body when the paper feeding tray is at the standby position and is located above the printing media stacked on the paper feeding tray when the paper feeding tray is at the paper feeding position.

19. The image forming apparatus according to claim 18, further comprising a retard roller located to face the paper feeding roller and having a torque limiter to convey one sheet of the printing media, picked up and conveyed by the pickup roller, at a time.

20. The image forming apparatus according to claim 17, further comprising a clutch element including:

a clutch spring having a body portion configured to be interference-fitted to a cylindrical portion of a bush fixed to the rotating shaft and a cylindrical portion of a flange provided at the pickup housing and serving to pivotally rotate the pickup housing in a downward movement direction of the pickup roller upon unidirectional rotation of the rotating shaft; and a sleeve surrounding the body portion, wherein one end of the body portion is supported by the pickup housing, and the other end of the body portion is supported by the sleeve.

21. The image forming apparatus according to claim 15, further comprising a binding device to bind the paper feeding tray and the upper paper feeding frame to each other so as to rotate the paper feeding frame in connection with open and closed positions of the paper feeding tray.

22. The image forming apparatus according to claim 15, wherein an elastic member is provided between the upper paper feeding frame and the pickup housing to elastically support the pickup housing in an upward movement direction of the pickup roller.

23. An image forming apparatus comprising:

a body having a rotating shaft to be rotated by a drive source installed in the body;

a paper feeding tray pivotally rotatably coupled to the body so as to be moved between a standby position to be closed with respect to the body and a paper feeding position to be open with respect to the body for paper feeding;

an upper paper feeding pivotally rotatable about the rotating shaft;

a pickup unit having a first roller coupled to the rotating shaft, a second roller spaced apart from the first roller so as to be rotated in linkage with the first roller, and a pickup housing to rotatably support the second roller, the pickup housing being pivotally rotatable about the rotating shaft; and a binding device to bind the paper feeding tray and the upper paper feeding frame to each other so as to pivotally rotate the upper paper feeding frame in connection with open and closed positions of the paper feeding tray, wherein the upper paper feeding frame is located in the body when the paper feeding tray is at the standby position, and is partially exposed to the outside of the body when the paper feeding tray is at the paper feeding position.

24. The image forming apparatus according to claim 23, wherein the second roller is movable to a first position corresponding to the standby position, a second position corresponding to the paper feeding position so as to be located above the printing media stacked on the paper feeding tray, and a third position so as to come into contact with the printing media stacked on the paper feeding tray.

25. The image forming apparatus according to claim 23, further comprising a lower paper feeding frame fixed to the body, wherein the lower paper feeding frame is rotatably provided with a retard roller at a position facing the first roller, the retard roller serving to convey one sheet of the printing media conveyed by the second roller at a time.

26. An image forming apparatus to form an image on a printing medium, comprising:

a body to define an outside shape of the image forming apparatus;

a tray rotatable between an open position to expose an opening into the body to receive the printing medium into the body, and a closed position to close the opening into the body; and a pickup unit having a first end connected to a shaft inside the body and a second end including a pickup roller to revolve around the shaft, such that the second end is located inside the body when the tray is in the closed position and the second end is located outside the body and the pickup roller is located opposite the tray when the tray is in the open position, wherein the pickup unit comprises:

a housing mounted to the shaft, the pickup roller being mounted to an end of the housing; and an upper paper-feeding frame mounted to the shaft, the upper paper-feeding frame being disposed above the housing to cover at least one portion of the housing when the tray is in the open position.

27. The image forming apparatus of claim 26, wherein the pickup unit includes a paper feeding roller to rotate around the shaft.

28. The image forming apparatus of claim 27, wherein the pickup unit further comprises:

an elastic member connected between the frame and the housing to bias the housing toward the frame.

29. The image forming apparatus of claim 28, wherein a first end of the upper paper-feeding frame is mounted to the shaft, and the image forming apparatus further comprises a binding device connected between a second end of the upper paper-feeding frame and the paper feeding tray to maintain a distance within a predetermined range between the upper paper-feeding frame and the paper feeding tray.

30. The image forming apparatus of claim 29, wherein the paper feeding tray includes a groove, and the binding device includes a protrusion to move linearly within the groove of the paper feeding tray.

31. The image forming apparatus of claim 29, wherein the pickup unit is movable between a first position inside the body of the image forming apparatus, a second position in which the pickup roller is positioned above the tray in an open position and in which the pickup roller is spaced apart from the tray so as to not apply pressure to the tray, and a third position in which the pickup roller applies pressure to the tray to pick up a printing medium on the tray.

32. The image forming apparatus of claim 31, wherein the pickup unit includes at least one clutch unit to maintain the pickup roller apart from the paper feeding tray in the second position and to press the pickup roller against the paper feeding tray in the third position.

33. The image forming apparatus of claim 32, wherein when the clutch unit presses the pickup roller against the paper feeding tray in the third position, the housing is maintained apart from the paper feeding tray by the binding device so as to not rotate with the housing toward the paper feeding tray.

34. A paper feeding device of an image forming apparatus, comprising:

a feeding tray to feed a printing medium into the image forming apparatus, the feeding tray rotatable between a closed position and an open position; and a pickup unit comprising:

a housing having a first end connected to a shaft inside a body of the image forming apparatus and a second end to rotate around the shaft; and a pickup roller mounted to the second end of the housing to pick up a printing medium from the feeding tray of the image forming apparatus when the feeding tray is in the open position and to be located within the image forming apparatus when the feeding tray is in the closed position, wherein an upper paper-feeding frame is disposed above the housing to cover at least one portion of the pickup unit when the feeding tray is in the open position.

* * * * *